US006720941B2

(12) United States Patent
Kashio

(10) Patent No.: US 6,720,941 B2
(45) Date of Patent: Apr. 13, 2004

(54) METHOD OF DRIVING AC SURFACE-DISCHARGE TYPE PLASMA DISPLAY PANEL

(75) Inventor: Yukinori Kashio, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 0 days.

(21) Appl. No.: 10/307,358

(22) Filed: Dec. 2, 2002

(65) Prior Publication Data

US 2003/0102814 A1 Jun. 5, 2003

(30) Foreign Application Priority Data

Nov. 30, 2001 (JP) ..... 2001-365650

(51) Int. Cl.[7] ..... G09G 3/28; G09G 3/10

(52) U.S. Cl. ..... 345/68; 345/60; 345/79; 345/77; 315/169.1; 315/169.4

(58) Field of Search ..... 345/68, 60, 63, 345/67, 77, 79, 76; 315/169.4, 169.3, 169.1

(56) References Cited

U.S. PATENT DOCUMENTS 6,456,263 B1 * 9/2002 Hashimoto et al. ..... 345/60
6,597,334 B1 * 7/2003 Nakamura ..... 345/68
2001/0030512 A1 * 10/2001 Mizobata ..... 315/160

* cited by examiner

*Primary Examiner*—Tuyet T. Vo
(74) *Attorney, Agent, or Firm*—Sughrue Mion, PLLC

(57) ABSTRACT

A method for driving a surface-discharge AC (alternating current)-type PDP (Plasma Display Panel) is provided which is capable of shortening a scanning period by securing a wide range in which a voltage to induce sustaining discharge can be set without causing flicker to occur and without causing black luminance to be increased. A sub-field is made up of a resetting period, a scanning period, a wall charge forming period, and a sustaining period. During the scanning period, time interval between scanning pulses is shortened. During the wall charge forming period, each of common electrodes and data electrodes is made to be at a ground potential and a wall charge forming pulse having a same potential as that of a scanning pulse is applied to all scanning electrodes. The time interval between wall charge forming pulses is for example 3 μsec to 50 μsec. This causes space charges being left in a display cell to be attracted on each of electrodes, whereby wall charges build up.

16 Claims, 13 Drawing Sheets

METHOD OF DRIVING AC SURFACE-DISCHARGE TYPE PLASMA DISPLAY PANEL

BACKGROUND OF THE INVENTION

1. Field of the Invention

The present invention relates to a method of driving an AC (Alternating Current) surface-discharge type plasma display panel that enables a scanning period to be shortened.

The present application claims priority of Japanese Patent Application No. 2001-365650 filed on Nov. 30, 2001, which is hereby incorporated by reference.

2. Description of the Related Art

Currently, two types of plasma display panels are available, one being a DC (Direct Current)-discharge type plasma display panel which is operated by exposing electrodes in a discharge space being filled with a discharging gas and by causing a DC discharge to occur between the exposed electrodes, and another being an AC-discharge type plasma display panel which is operated, with electrodes not directly being exposed in the discharging gas by coating electrodes with dielectric layers, in a state in which AC-discharge occurs. There are two types of the AC-discharge type plasma display panels, one having two electrodes in a display cell and another having three electrodes in the display cell. Configurations and driving methods of a conventional three-electrode-surface-discharge AC-type plasma display panel (hereinafter may be referred simply to as a "PDP") are described below.

FIG. 6 is a perspective view showing configurations of one display cell in the PDP. As shown in FIG. 6, in the display cell, an insulating substrate 1 serving as a rear substrate made of a transparent material such as glass and an insulating substrate 2 serving as a front substrate also made of transparent material such as glass are mounted in parallel to each other. On a surface of the insulating substrate 2 facing the insulating substrate 1 are placed a plurality of transparent scanning electrodes 3 and a plurality of common electrodes 4 alternately at specified intervals. On each of the scanning electrodes 3 and on each of the common electrodes 4 are formed a trace electrode 5 and a trace electrode 6 respectively both serving to reduce an electrode resistance value of each of the scanning electrode 3 and of the common electrodes 4. Moreover, a dielectric film 12 is formed in a manner that it covers the scanning electrodes 3, common electrodes 4, and the trace electrode 5 and electrode 6. On the dielectric film 12 is formed a protective layer 13 made of magnesium oxide or a like which prevents the dielectric film 12 from being affected by discharge.

Moreover, on a surface of the insulating substrate 1 facing the insulating substrate 2 is mounted a plurality of data electrodes 7 each extending in a direction orthogonal to each of the scanning electrodes 3 and the common electrodes 4. On the data electrodes 7 is formed a dielectric film 14 in a manner so as to cover the data electrodes 7.

Between the insulating substrate 1 and the insulating substrate 2 are formed ribs 9 (that is, partitioning walls) used to provide space 8 for discharging gas and to partition a display cell (picture cell). The space 8 for discharging gas is filled with an inert gas such as helium, neon, xenon, or a like or mixed gases of these inert gases. Moreover, on a surface of the dielectric film 14 and on a side of each of the ribs 9 are formed phosphors 11 used to absorb ultraviolet rays produced by discharge of the above gas and to emit visible light 10.

FIG. 7 is a top view schematically showing arrangements of electrodes used in the conventional PDP shown in FIG. 6. As shown in FIG. 7, "n" (n is a natural number) pieces of the scanning electrodes 3 (see FIG. 6) (S1 to Sn); "n" pieces of the common electrodes 4 (see FIG. 6) (C1 to Cn), and "m" (m is a natural number) pieces of the data electrodes 7 (see FIG. 6) (D1 to Dm) are provided in the PDP. Also, as shown in FIG. 7, the PDP is provided with "n" pieces of the scanning electrodes S extending in parallel to one another, "n" pieces of the common electrodes C extending in parallel to one another, and "m" pieces of the data electrodes D extending in a direction orthogonal to the scanning electrodes S and common electrodes C. Display cells 15 are formed, each emitting light and each containing one nearest contact of one of the data electrodes D to one of the scanning electrodes S and one nearest contact of one of the data electrodes D to one of the common electrodes C. That is, one of the scanning electrodes S, one of the common electrodes C, and one of the data electrodes D pass through each of the display cells 15. The display cells 15 are arranged in a matrix form. Therefore, a total number of display cells 15 on an entire screen of the PDP is "(n×m)".

Next, a method for driving the conventional PDP is described below. FIG. 8 is a timing chart showing periods contained in one field in the method for driving the conventional PDP. The method shown in FIG. 8 is called a "sub-field method". For example, images being switched at a rate of one piece per one sixtieth of a second are displayed in one field 20 which is made up of eight sub-fields SF1 to SF8 and a number of times of sustaining discharge occurring in each sub-field is set to be values each being proportional to a power of two so as to be made different from one another. Here, let it be assumed that the number of times of the sustaining discharge in each of the sub-fields SF1 to SF8 is given by 27k=128k, 26k=64k, 25k=32k, 24k=16k, 23k=8k, 22k=4k, 21k=2k, and 20k=1k, respectively, where "k" is a constant coefficient. Then, by arbitrarily selecting sub-fields during which the sustaining discharge occurs, out of these sub-fields SF1 to SF8, and by combining the selected sub-fields, 256 shades of gray are made to be displayed in each of the display cells 15.

FIG. 9 is a diagram showing waveforms of pulses used in the conventional method for driving the PDP for each of the conventional sub-fields (SF1 to SF8). FIGS. 10A to 10C and FIGS. 11A to 11B are diagrams schematically illustrating arrangements of wall charges formed in each of the display cells 15 when the driving method shown in FIG. 9 is executed. FIGS. 10A to 10B are diagrams illustrating arrangements of wall charges formed during a resetting period 21. FIG. 10C is a diagram illustrating arrangements of wall charges formed during a scanning period 22, FIGS. 11A and 11B are diagrams illustrating arrangements of wall charges formed during a sustaining period 23. As shown in FIG. 9, according to the method employed in the above example, each of the sub-fields SF1 to SF8 is divided into the resetting period 21, the scanning period 22, and the sustaining period 23. Hereinafter, operations during each of the above periods the resetting period 21, the scanning period 22, and the sustaining 23 making up the sub-field are explained by referring to FIG. 9, FIGS. 10A to 10C, and FIGS. 11A and 11B. In FIGS. 10A to 10C and FIGS. 11A and 11B, a positive wall charge is expressed by a symbol obtained by enclosing "+" with a circle and a negative wall charge is expressed by a symbol obtained by enclosing "−" with a circle.

During the resetting period 21, wall charges formed in a previous sub-field (not shown) are erased and displayed data is reset. During the resetting period 21, a priming pulse of a positive polarity Vp+ is applied to each of the scanning electrodes S and, at a same time, a priming pulse of a negative polarity Vp− is applied to each of the common electrodes C. Each of the data electrodes D is set to be at a ground (GND) potential. A total voltage of the priming pulse of the positive polarity Vp+ and the priming pulse of the negative polarity Vp− is set to be more than a surface-discharge firing voltage of the conventional PDP. This causes, as illustrated as a state "A1" in FIG. 10A, priming discharge (preliminary discharge) to occur between a surface of the dielectric film 12 (see FIG. 6) corresponding to that over the scanning electrodes S (hereinafter may be simply referred to as "the surface over the scanning electrode S") and a surface of the dielectric film 12 corresponding to that over the common electrodes C (hereinafter may be simply referred to as "the surface over the common electrode C"). After the occurrence of the priming discharge, as illustrated as a state "A2" in FIG. 10A, negative wall charges are formed (build up) over the specified scanning electrodes S, whereas positive charges are formed (build up) over the specified common electrodes C. After the occurrence of the priming discharge, wall charges are formed in each of the display cells 15 in a manner that a potential being applied to each of the scanning electrodes S and the common electrodes C is countered and, as a result, an electric field in each of the display cells 15 becomes uniform. Therefore, states of the wall charges formed in each of the display cells 15 after the occurrence of the priming discharge becomes the same irrespective of states of wall charges formed in the previous sub-field.

Next, while each of the data electrodes D is kept at a GND potential, a priming erasing pulse Vpe of a negative polarity having a saw-tooth shaped waveform is applied to each of the scanning electrodes S and, at a same time, each of the common electrodes C is made to be at a GND potential. The priming erasing pulse Vpe is a pulse whose potential is lowered continuously from its GND level, which causes a difference in potential to be continuously increased between the surface over the scanning electrodes S and the surface over the common electrodes C and, as a result, as illustrated as the state "A3" in FIG. 10B, feeble discharge (priming erasing discharge) occurs between the surface over the scanning electrodes S and the surface over the common electrodes C. Moreover, the feeble discharge represents feeble discharge which continues with a voltage between discharging gaps being kept almost at a discharge firing voltage. This causes, as illustrated as a state "A4" in FIG. 10B, wall charges formed by the priming discharge described above (see FIG. 10A) to be erased. As a result, states of wall charges in each of the display cells 15 are reset.

During the scanning period 22, with each of the common electrodes C being kept at a GND potential, a scanning pulse Vw of a negative polarity is applied sequentially to each of the scanning electrodes S1 to Sn. Moreover, during a period of time contained in the scanning period 22 in which the scanning pulse Vw is not applied to each of the scanning electrodes S1 to Sn, a scanning base pulse Vbw of a negative polarity having a constant voltage is applied to each of the scanning electrodes S1 to Sn. The application of the scanning base pulse Vbw to each of the scanning electrodes S1 to Sn causes an amplitude of the scanning pulse Vw to be decreased, which allows a voltage used by a driving IC operated to apply the scanning pulse Vw to be lowered. This can achieve reduction in costs of the PDP production.

Then, a data pulse Vd of a positive polarity is selectively applied, in synchronization with the scanning pulse Vw, to each of the data electrodes D, based on display data. At this point, each of voltages of the scanning pulse Vw and the data pulse Vd is set so as to be individually less than a opposed-discharge firing voltage and is so set that a voltage obtained by superimposing the scanning pulse Vw on the data pulse Vd is not less than the opposed-discharge firing voltage. Moreover, a voltage of the scanning base pulse Vbw is so set that a voltage obtained even by superimposing the scanning base pulse Vbw on the data pulse Vd is less than the opposed-discharge firing voltage.

This enables, as illustrated as a state "A5" in FIG. 10C, writing discharge to occur only in a display cell selected out of the display cells 15 based on display data, that is, only in the display cell to which the data pulse Vd is applied in synchronization with the scanning pulse Vw. Here, first, opposed-discharge occurs between over the specified scanning electrodes S and a surface of the dielectric film 14 (see FIG. 6) corresponding to that over the specified data electrodes D (hereinafter may be simply referred to as "that over the data electrode D"), and then the opposed-discharge triggers surface-discharge to occur between the surface over the scanning electrodes S and the surface over the common electrodes C. A reason why such the surface-discharge occurs is that activated particles such as electrons, atoms, metastable atoms, or like produced in each of the display cells 15 when the above opposed-discharge occurred lower a threshold voltage for the surface-discharge. Discharge obtained by putting the opposed-discharge and surface-discharge together is called "writing discharge". Moreover, a display cell where writing discharge has occurred is called a "selected display cell" and a display cell where the writing discharge has not occurred is called a "non-selected display cell".

Furthermore, by making the surface over the scanning electrodes S be of a negative polarity when the opposed-discharge making up the writing discharge occurs, bombardment of the protective layer 13 (see FIG. 6) made of MgO (Magnesium Oxide) with a positive ion contained in discharging gas occurs and, as a result, a secondary electron is emitted. The secondary electron is moved to a positive polarity side by an electric field applied to the specified display cells 15 and, as a result, collides with a molecule of the discharging gas, which causes the discharging gas molecule to be ionized to positive ions and electrons. This causes the positive ions and electrons to be further supplied to each of the display cells 15, thus enabling discharge to continuously occur. Moreover, the phosphor 11, when being radiated with ultraviolet rays produced by discharge, emits visible light 10, however, since the ultraviolet rays are not allowed to pass through the MgO layer, the protective layer 13 is preferably formed on a surface of the insulating substrate 2, that is, on the scanning electrodes 3 and common electrodes 4.

As illustrated as a state "A6" in FIG. 10C, positive wall charges are formed by the writing discharge on each of the scanning electrodes S and negative wall charges are formed by the writing discharge on each of the common electrodes C and on each of the data electrodes D. The display cell (selected display cell), out of the display cells 15, in which the writing discharge has occurred, serves as a display cell emitting light during the sustaining period 23 described later. Moreover, in the selected display cell, out of the display cells 15, in which the writing discharge has not occurred, states on one of the scanning electrodes S, common electrodes C, and data electrodes D which are arranged within the above display cell remain to be same as illustrated as the state "A4" in FIG. 10B, with no wall charges being formed. After the application of the scanning pulse Vw to all the scanning electrodes S has been completed, the scanning period 22 ends and then the sustaining period 23 starts.

During the sustaining period 23, only the display cells 15 selected during the scanning period emit light to perform actual display of images. During the sustaining period 23, each of the data electrodes D is always kept at a GND potential. First, each of the scanning electrodes S is made to be at a GND potential and then a sustaining pulse Vs of a negative polarity is applied to each of the common electrodes C. The sustaining pulse Vs is so set that a difference between a potential of the sustaining pulse Vs and a GND potential is less than a surface-discharge firing voltage and that a voltage of the sustaining pulse Vs exceeds a voltage obtained by subtracting a voltage (wall voltage) induced by the wall charges (see the state "A6" in FIG. 10C) formed by the writing discharge described above from the surface-discharge firing voltage. Therefore, in the display cells 15 in which the writing discharge occurred during the scanning period 22, since, as illustrated as the state "A6" in FIG. 10C, positive wall charges are formed on each of the scanning electrodes S being arranged within the display cells 15 and negative wall charges are formed on each of the common electrodes C being arranged within the display cells 15, the wall voltage induced by the wall charge is superimposed on the voltage of the sustaining pulse Vs and the resulting voltage exceeds a threshold value for surface-discharge (that is, surface-discharge firing voltage). Thus, as illustrated as a state "A7" in FIG. 11A, first-time sustaining discharge occurs between the surface over the scanning electrode S and the surface over the common electrodes C. When the first-time sustaining discharge has occurred, as illustrated as a state "A8" in FIG. 11A, negative wall charges are formed on each of the scanning electrodes S being arranged within each of the display cells 15 and positive wall charges are formed on each of the common electrodes C being arranged within each of the display cells 15. Then, as illustrated as a state "A9" in FIG. 11B, the sustaining pulse Vs of a negative polarity is applied to each of the scanning electrodes S being arranged in each of the display cells 15 and each of the common electrodes C being arranged in each of the display cells is made to be at a GND potential. This causes, in the display cells 15 in which the first-time sustaining discharge has occurred, the wall charges produced by the first-time sustaining discharge to be superimposed on the voltage of the sustaining pulse Vs applied to each of the scanning electrodes S and the resulting voltage to exceed the surface-discharge firing voltage, which causes a second-time sustaining discharge to occur. As a result, as illustrated as a state "A10" in FIG. 11B, positive wall charges are formed on each of the scanning electrodes S and negative wall charges on each of the common electrodes C. Thereafter, similarly as above, a wall voltage induced by wall charges produced by x-th time sustaining discharge is superimposed on a voltage of the sustaining pulse Vs applied (x+1)-th time, which causes (x+1)-th time sustaining discharge to occur.

On the other hand, in non-selected display cells out of the display cells 15 in which the writing discharge has not occurred during the scanning period 22, as illustrated as the state "A4" in FIG. 10, since no wall charge is formed, no wall voltage is superimposed on a voltage of the sustaining pulse Vs, thus causing no occurrence of a first-time discharge. Therefore, no sustaining discharge occurs second time and thereafter.

Thus, by repeatedly applying the sustaining pulse, it is possible to have only the display cells 15 selected during the scanning period 22 emit light. Each of the display cells 15 can achieve a desired display of images by selecting sub-fields during which the display cells 15 are to emit light and combining the sub-fields.

However, the conventional technologies described above present following problems as below. That is, when the driving method described above is employed, as the scanning period in one sub-field, time being equivalent to a product of a number of scanning electrodes S (numbers of lines) and writing time (scanning time) is needed and, for example, when a number of lines of the scanning electrodes S is 480 and scanning time per one line is 3 μsec, if one field is made up of eight sub-fields, 11.5 ms is required as total scanning time. The required time of 11.5 ms, when one frame is equivalent to one sixtieths seconds, accounts for about 70% of total time required for driving. That is, the sustaining time during which images are actually displayed accounts for less than 30%.

Recently, it is to be wished that a PDP becomes further higher in definition and can provide increased numbers of shades of gray. However, to make the PDP high definition, a number of scanning lines has to be increased, and to increase the number of shades of gray, a number of sub-fields constituting one field has to be increased and, in either case, an increase in total scanning time is unavoidable. If a ratio of the scanning period to one field increases, a ratio of the sustaining period to one field decreases, which causes luminance of images to be lowered. Therefore, in order to achieve higher definition of the PDP and the increase in the number of shades of gray in the PDP, scanning time per one line has to be shortened, the increase in the ratio of the scanning time to one field has to be inhibited so that a sufficient sustaining period has to be secured.

However, here, a problem arises in that, if scanning time per one line is shortened, a range within which a voltage of the sustaining pulse Vs (hereinafter referred to as a "sustaining voltage" that enables normal display of images can be set becomes narrow and, in a worst case, a screen flickers. Hereinafter, this problem is described in detail.

FIG. 12 is a graph showing, by plotting a scanning period, that is, scanning time per one line as the abscissa and a sustaining voltage as the ordinate, dependence of a minimum sustaining voltage (Vsmin) required for having sustaining discharge occur in a stable manner and a maximum sustaining voltage (Vsmax) needed to prevent non-selected display cells from emitting light erroneously on a scanning period. Within a range 33 of sustaining voltages encircled by a line showing the minimum sustaining voltage (Vsmin) and a line showing the maximum sustaining voltage (Vsmax) shown in FIG. 12, normal display of images is made possible. Moreover, a size of a panel of the PDP used in measurement in the example is 50 inches. The PDP was driven by the conventional method for driving shown in FIG. 9. As shown in FIG. 12, as the scanning period is more shortened, the minimum sustaining voltage (Vsmin) increases and, at a point where the scanning period is 1 μsec, the minimum sustaining voltage (Vsmin) is larger than the maximum sustaining voltage (Vsmax). That is, if the scanning period is set to be 1 μsec, normal driving of the PDP becomes impossible.

Hereinafter, its reason is explained. FIGS. 13A and 13B are diagrams schematically illustrating behavior in which wall charges are formed after application of a scanning pulse and FIG. 13A shows a case where the scanning period is sufficiently long and FIG. 13B shows a case where the scanning period is short. As shown in FIG. 13A, a certain period of time 31 is needed before a time when light-emitting F occurs since the application of the scanning pulse Vw to each of the scanning electrodes S. Then, when the light-emitting F occurs, discharging gas in each of the display cells 15 is ionized and, as a result, electrons and ions are produced in each of the display cells 15. A period existing after the occurrence of the light-emitting F in the period during which the scanning pulse Vw is being applied to each of the scanning electrodes S is a wall charge attracting period 32. During the wall charge attracting period 32, by an electric field applied within each of the display cells 15, ions produced by the light-emitting F are attracted on each of the scanning electrodes S and electrons produced by the light-emitting F are attracted on each of the common electrodes C and on each of the data electrodes D and, as a result, positive wall charges are formed on each of the scanning electrodes S and negative wall charges are formed on each of the common electrodes C and on each of the data electrodes D.

However, as shown in FIG. 13B, if the scanning period 22, that is, the period during which the scanning pulse Vw is applied to each of the scanning electrodes S is short, the wall charge attracting period 32 becomes short accordingly. As a result, ions and electrons produced in each of the display cells 15 are not attracted sufficiently on each of the scanning electrodes S, the common electrodes C, and the data electrodes D, thus resulting in insufficient formation of the wall charges. Moreover, the electric field produced by the scanning base pulse Vbw being applied to each of the scanning electrodes S after the occurrence of the writing discharge serves to move electrons and ions to each of the scanning electrodes S, the common electrodes C, and the data electrodes D and to induce the formation of wall charges. Therefore, in each of the display cells 15 where the writing discharge occurs in an early stage of the scanning period 22, even if the formation of wall charges induced by the scanning pulse Vw is not sufficient, during the scanning period 22 and thereafter, wall charges are formed, to some extent, by the scanning base pulse Vbw. However, in the display cells 15 in which the writing discharge occurs in a last stage in the scanning period 22, that is, in the display cells 15 existing in a vicinity of a final line to be scanned, if the formation of wall charges induced by the scanning pulse Vw is insufficient, since a period of time during which the scanning base pulse Vbw is applied in the scanning period 22 and thereafter is short, almost no wall charges induced by the scanning base pulse Vbw are formed, as a result, causing the above-described problem to be more serious.

To solve this problem, technology is disclosed in Japanese Patent Application Laid-open No. 2000-206933 in which writing discharge is caused to occur at a high voltage. In this technology, a sub-field is made up of a preliminary discharge period, a scanning period, a converting period, and a sustaining period. Wall charges are formed in a last stage of the preliminary discharge period between the surface over the scanning electrode S and the surface over the data electrodes D. Next, during the scanning period, a data pulse is applied to each of the data electrodes D in a display cell not emitting light and no data pulse is applied to each of the data electrodes D in a display cell emitting light. This causes a relatively large amount of wall charges to occur in the display cell not emitting light and a relatively small amount of wall charges to occur in the display cell emitting light. Then, during the converting period, discharge is made to occur only in the display cell not emitting light to erase the wall charges. As a result, during the sustaining period, sustaining discharge does not occur in the display cell not emitting light and occurs only in the display cell emitting light. Thus, according to this technology, since writing discharge is made to occur at a high voltage, wall charge can be effectively formed after the occurrence of the writing discharge and the scanning time can be shortened accordingly.

However, the technology disclosed in the above Japanese Patent Application Laid-open No. 2000-206933 presents a problem described below. That is, in the driving method employed in the disclosed technology, discharge is made to occur in a display cell not emitting light during the scanning period and the converting period. Therefore, the discharge causes light to be emitted in a display cell in which no discharge occurs, as a result, another problem arises in that luminance (black luminance) increases when a black color is displayed.

SUMMARY OF THE INVENTION

In view of the above, it is an object of the present invention to provide a method of driving an AC surface-discharge type plasma display panel capable of shortening a scanning period by securing a wide range in which a voltage to induce sustaining discharge can be set without causing a flicker to occur and black luminance to be increased.

According to a first aspect of the present invention, there is provided a method of driving a surface-discharge alternating current-type plasma display panel having first and second insulating substrates placed so as to face each other, a plurality of scanning electrodes and a plurality of common electrodes being placed on a side of a face of the first insulating substrate facing the second insulating substrate and being extended in a first direction and being alternately arranged, a first dielectric layer to cover the plurality of the scanning electrodes and the plurality of the common electrodes, a plurality of data electrodes being placed on a side of a face of the second insulating substrate facing the first insulating substrate and being extended in a second direction orthogonal to the first direction, and a second dielectric layer to cover the plurality of the data electrodes, for having a surface-discharge alternating-current-type plasma display panel, in which picture cells are formed in a matrix form in a manner that each of the picture cells contains one nearest contact point of one of the plurality of the data electrodes to each of the plurality of the scanning electrodes and one nearest contact point of each of the plurality of the data electrodes to each of the plurality of the common electrodes and that a discharge gap is formed between each of the plurality of the scanning electrodes and each of the plurality of the common electrodes in each of the picture cells, display images based on display data, the method including:

a step of constructing one field to display one image of one sub-field or a plurality of sub-fields and;

wherein the sub-field is made up of a resetting period during which a state of an electric charge in each of the picture cells is initialized, a scanning period during which a scanning pulse is sequentially applied to each of the scanning electrodes and, at a same time, a data pulse is selectively applied, based on the display data, to the data electrodes with same timing as for the scanning pulse to cause writing discharge to selectively occur in each of picture cells, a wall charge forming period during which wall charges are formed in the picture cells where the writing discharge has occurred by application of a wall charge forming pulse having an orientation of an electric field determined by a relative relation of potentials among three types of electrodes one being the scanning electrodes, another being common electrodes, and an other being data electrodes being same as an orientation of an electric field produced at a time of the writing discharge during the scanning period, to one electrode or two or more electrodes selected from a group consisting of the scanning electrodes, the common electrodes, and data electrodes, and a sustaining period during which sustaining discharge is made to occur between a scanning electrode region over the scanning electrode in a surface of the first dielectric layer and a common electrode region over the common electrode in the surface of the first dielectric layer in the picture cell where wall charges have been formed by applying a sustaining pulse alternately to the scanning electrode and the common electrode.

According to a second aspect of the present invention, there is provided a method of driving an AC surface-discharge type plasma display panel having: a first insulating substrate and a second insulating substrate arranged opposite each other, a plurality of scanning electrodes and a plurality of common electrodes alternatively arranged on an opposition surface of the first insulating substrate to the second insulating substrate in a first direction, a plurality of data electrodes arranged on an opposition side of the second insulating substrate to the first insulating substrate in a second direction perpendicular to the first direction, a first dielectric layer formed to cover the plurality of scanning electrodes and the plurality of common electrodes, a second dielectric layer formed to cover the plurality of data electrodes, a plurality of discharge gaps arranged between the scanning electrodes and the common electrodes, and a plurality of picture cells each of which includes one of cross points of the discharge gaps and data electrodes;

a step of constructing one field to display one image of one sub-field or a plurality of sub-fields and;

wherein the sub-field is made up of a resetting period during which a state of an electric charge in each of the picture cells is initialized, a scanning period during which a scanning pulse is sequentially applied to each of the scanning electrodes and, at a same time, a data pulse is selectively applied, based on the display data, to the data electrodes with same timing as for the scanning pulse to cause writing discharge to selectively occur in each of picture cells, a wall charge forming period during which wall charges are formed in the picture cells where the writing discharge has occurred by application of a wall charge forming pulse having an orientation of an electric field determined by a relative relation of potentials among three types of electrodes one being the scanning electrodes, another being common electrodes, and an other being data electrodes being same as an orientation of an electric field produced at a time of the writing discharge during the scanning period, to one electrode or two or more electrodes selected from a group consisting of the scanning electrodes, the common electrodes, and the data electrodes, and a sustaining period during which sustaining discharge is made to occur between a scanning electrode region over the scanning electrode in a surface of the first dielectric layer and a common electrode region over the common electrode in the surface of the first dielectric layer in the picture cell where wall charges have been formed by applying a sustaining pulse alternately to the scanning electrode and the common electrode.

In configurations according to the foregoing first and second aspect, the wall charge forming period is provided between the scanning period and the sustaining period. During the wall charge forming period, by applying the wall charge forming pulse to one electrode or two or more electrodes selected from a group consisting of the scanning electrodes, the common electrodes, and the data electrodes, an electric field being determined by a relative relation in potentials among the three types of electrodes within each of the picture cells is made to occur. An orientation of the electric field is same as that of the electric field produced at the time of writing discharge. Moreover, the orientation of the electric field does not represent a direction of the electric field, that is, represents a polarity of an electric field relative to the electrode and, for example, the electric field existing on a side of each of the scanning electrodes in a picture cell is defined to be of a positive polarity relative to a side of each of the data electrodes and the electric field existing on a side of each of the data electrodes in the picture cell is defined to be of a negative polarity. During the scanning period, discharging gas is ionized by the occurrence of writing discharge in each of the picture cells and ions and electrons are produced in each of the picture cells. By applying the above electric field after the occurrence of the writing discharge, the ions and electrons are attracted on each of the scanning electrodes, the common electrodes, and the data electrodes and wall charges are formed in each of the picture cells. As a result, even if the time interval between the scanning pluses is short and sufficient wall charges can not be formed within application time of the scanning pulse, wall charges can be formed during the wall charge forming period and the sustaining discharge can be made to occur during the sustaining period. This enables scanning pulses to be shortened without causing a flicker on a screen. As a result, the scanning period can be shortened without causing an increase in black luminance and the sustaining period can be secured, thereby enabling improvement of luminance, increases in scanning lines and in the number of shades of gray.

In the foregoing, a preferable mode is one wherein a time interval between the wall charge forming pulses is 3 $\mu$sec to 50 $\mu$sec.

By making the time interval between the wall charge forming pulses be not less than 3 $\mu$sec, a voltage setting range of the sustaining pulse is made wider and a stable driving of the PDP is made easier. On the other hand, by making the time interval between the wall charge forming pulses be less than 50 $\mu$sec, saturation of the effects by the wall charge forming pulse can be prevented and, during the wall charge forming period, wall charges can be effectively formed.

Also, a preferable mode is one, wherein, during the scanning period, a scanning pulse of a negative polarity is applied to each of the scanning electrodes and, at a same time, a data pulse of a positive polarity is applied selectively to the desired data electrodes and wherein, during the wall charge forming period, a wall charge forming pulse of a negative polarity is applied to each of the scanning electrodes.

By operating above, during the wall charge forming period, an electric field having almost the same direction as that provided at a time of writing discharge can be applied and positive wall charges can be formed on each of the scanning electrodes and negative wall charges can be formed on each of the common electrodes and the data electrodes.

Also, a preferable mode is one wherein, during the scanning period, a scanning pulse of a negative polarity is applied to each of the scanning electrodes and, at a same time, a data pulse of a positive polarity is selectively applied to the desired data electrodes and wherein, during the wall charge forming period, a wall charge forming pulse of a positive polarity is applied to the common electrodes.

By operating above, positive wall charges can be formed on each of the scanning electrodes and negative wall charges can be formed on each of the common electrodes and, at a same time, a large amount of negative wall charges can be formed on each of the data electrodes. This enables not only surface-discharge but also opposed-discharge to occur in the sustaining discharge and occurrence of the sustaining discharge to be more stable.

Also, a preferable mode is one wherein, during the scanning period, a scanning pulse of a negative polarity is applied to each of the scanning electrodes and, at a same time, a data pulse of a positive polarity is selectively applied to the desired data electrodes and wherein, during the wall charge forming period, a wall charge forming pulse of a negative polarity is applied to each of the scanning electrodes and, at a same time, a wall charge forming pulse of a positive polarity is applied to the desired data electrodes.

Also, a preferable mode is one wherein the wall charge forming pulse of a positive polarity to be applied to the desired data electrodes is obtained by extending time for application of a final data pulse during the scanning period.

By operating above, a driving waveform can be simplified.

Also, a preferable mode is one wherein, during a period of time within the scanning period in which the scanning pulse is not applied to each of the scanning electrodes, a scanning base pulse of a negative polarity whose voltage is less than a voltage obtained by subtracting a voltage of the data pulse from a opposed-discharge firing voltage is applied to each of the scanning electrodes.

By operating above, an amplitude of the scanning pulse can be made smaller and reduction in costs of PDP production can be achieved.

Furthermore, a preferable mode is one wherein the wall charge forming pulse is obtained by extending time for application of the scanning base pulse.

By operating above, a driving waveform can be simplified.

Thus, with the above configurations, an amount of wall charges formed after the occurrence of writing discharge can be increased and a stable shift from a writing period to a sustaining period is made possible. This enables flicker, which occurred in a vicinity of a final line to be scanned due to insufficient formation of wall charges at a time of writing encountered when a scanning period is set to be short as in the conventional technology, to be improved and excellent images to be displayed. As a result, the scanning period can be shortened without causing an increase in black luminance and idle time given by the shortening of the scanning period can be assigned to increase the number of sustaining pulses, sub-fields, and scanning lines. This enables luminance to be enhanced and the number of shades of gray to be increased and image quality to be improved in the PDP.

BRIEF DESCRIPTION OF THE DRAWINGS

The above and other objects, advantages, and features of the present invention will be more apparent from the following description taken in conjunction with the accompanying drawings in which:

FIG. 4B is a diagram illustrating an arrangement of wall charges formed during a scanning period;

FIGS. 10A and 10B are diagrams illustrating arrangements of wall charges formed during a resetting period and FIG. 10C is a diagram illustrating arrangements of wall charges formed during a scanning period;

DETAILED DESCRIPTION OF THE PREFERRED EMBODIMENTS

Best modes of carrying out the present invention will be described in further detail using various embodiments with reference to the accompanying drawings.

First Embodiment

Figure 1:
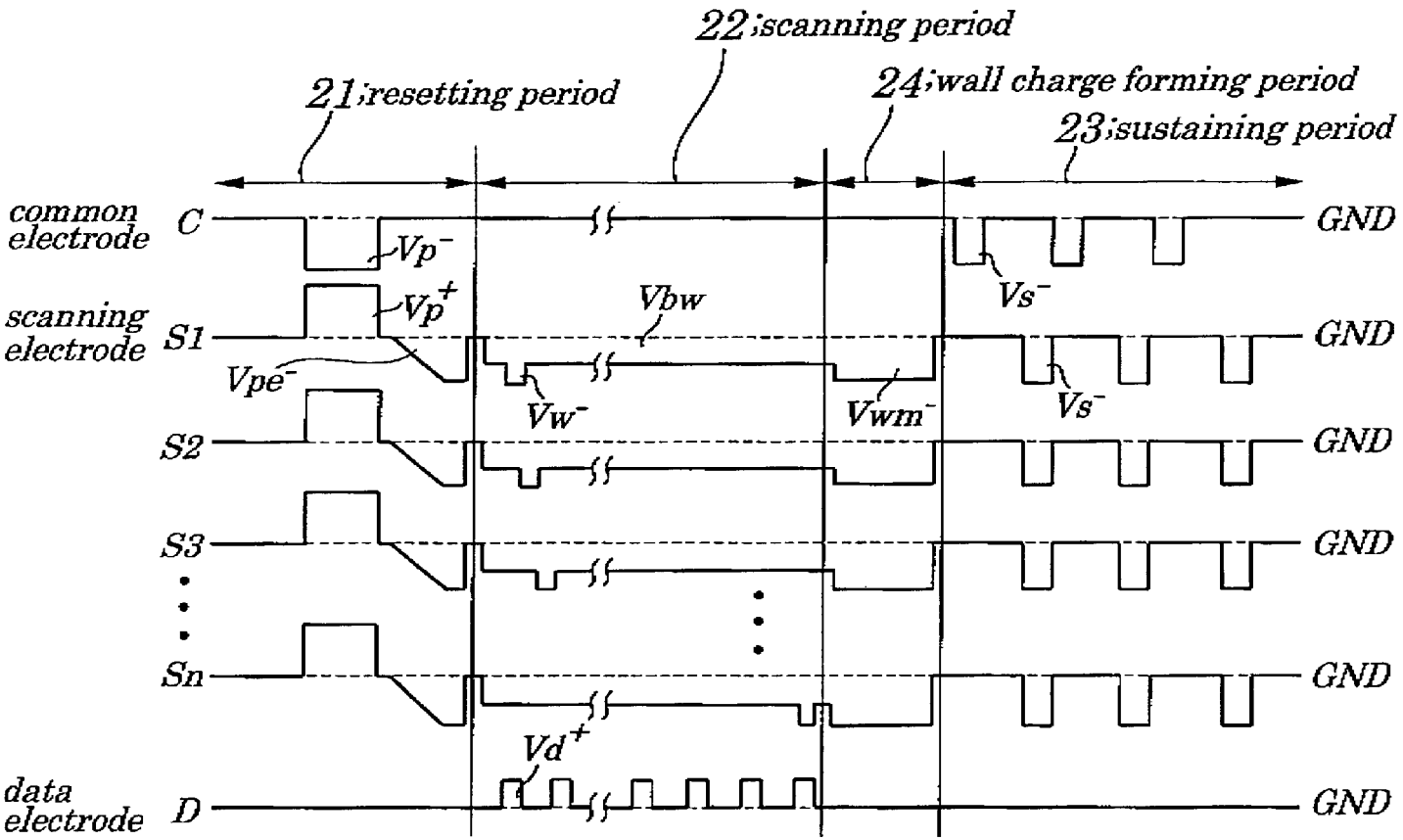
FIG. 1 is a diagram showing waveforms in one sub-field for a method of driving a PDP according to a first embodiment of the present invention.
Figure 2:
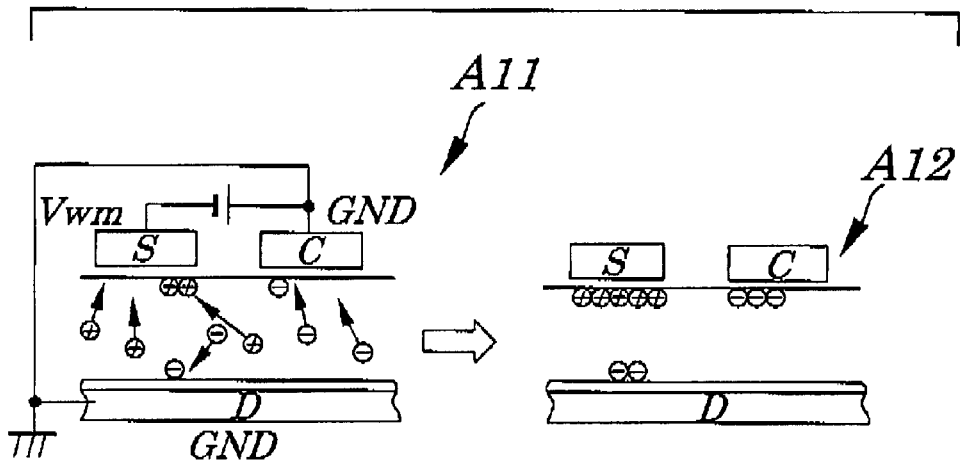
FIG. 2 is a schematic diagram illustrating an arrangement of wall charges formed in each of display cells during a wall charge forming period by the method of driving the PDP shown in FIG. 1.
Figure 6:
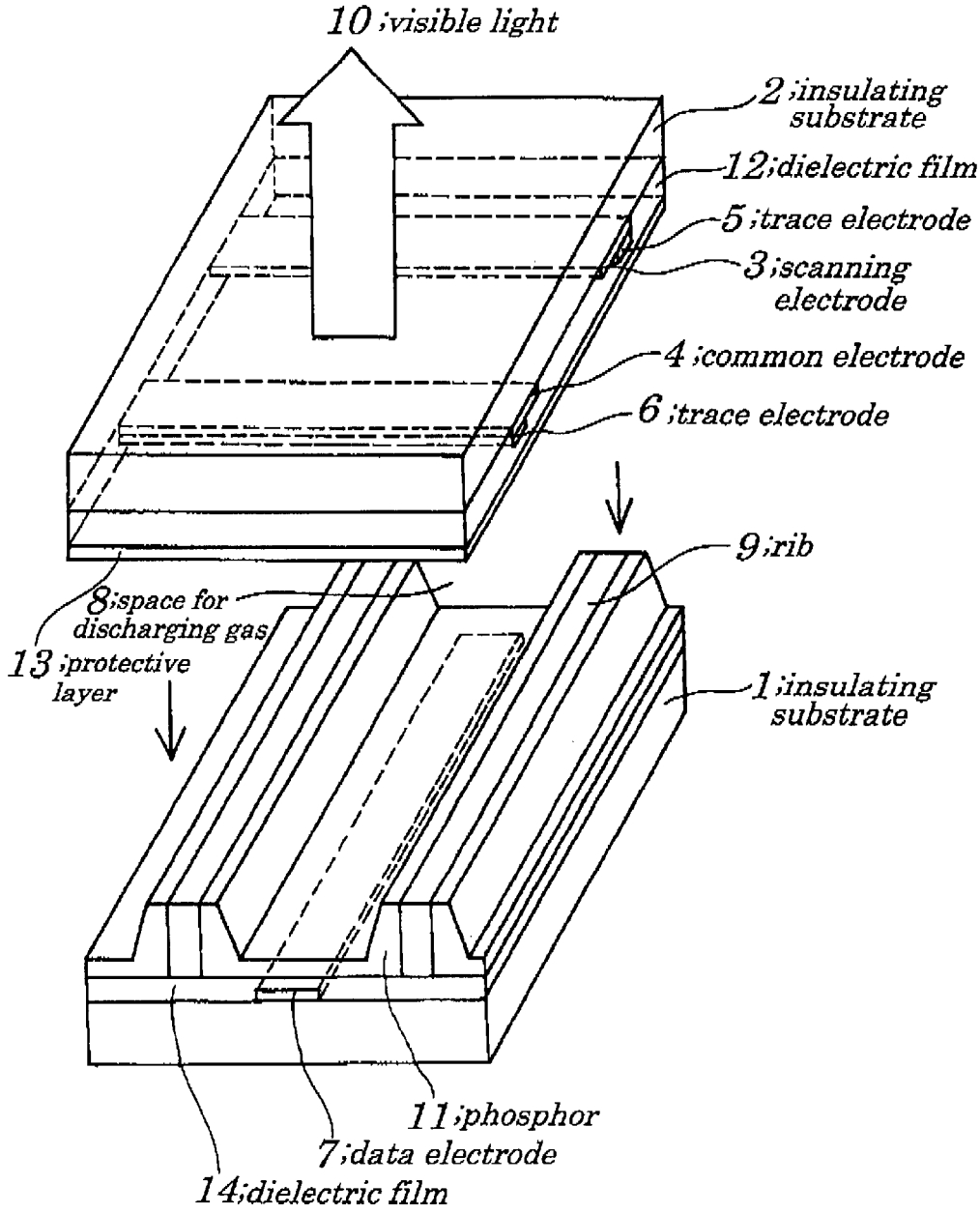
FIG.6 (PRIOR ART)
FIG. 6 is a perspective view showing configurations of one display cell in a conventional three-electrode-surface-discharge AC-type PDP.
Figure 7:
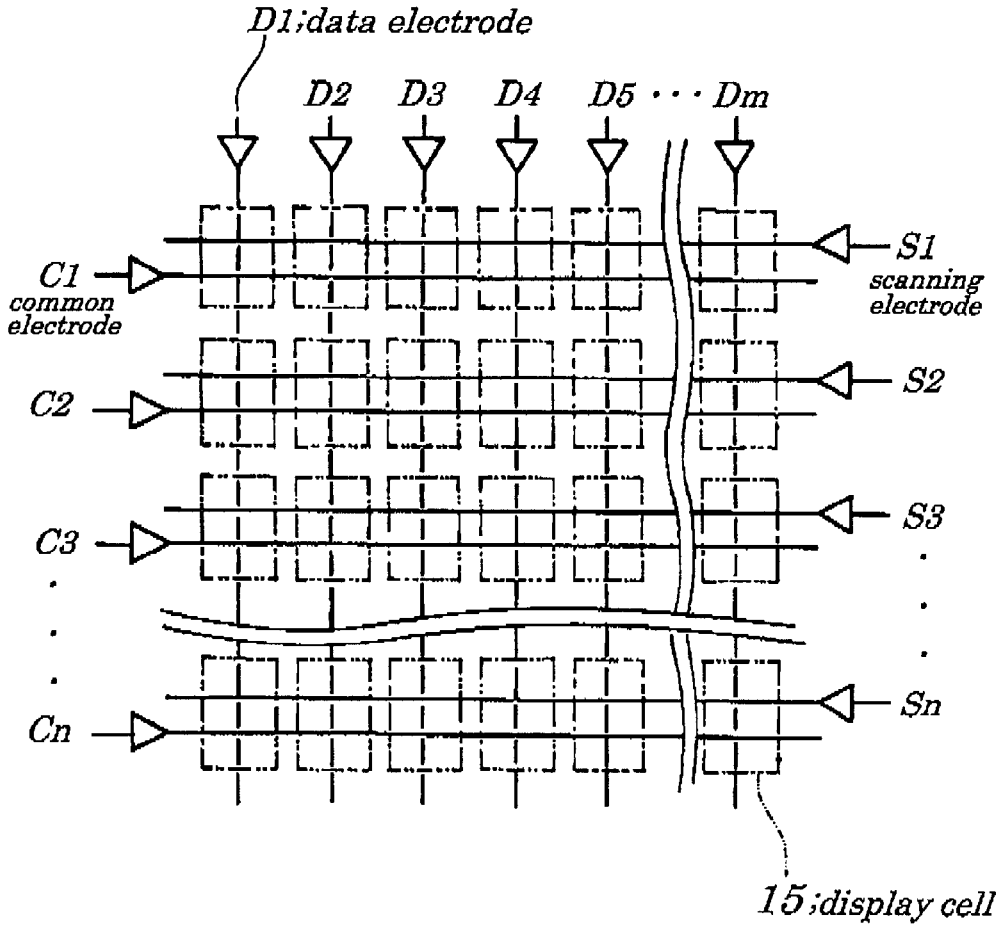
FIG. 7 (PRIOR ART)
FIG. 7 is a top view schematically showing arrangements of electrodes used in the conventional PDP shown in FIG. 6.
Figure 8:
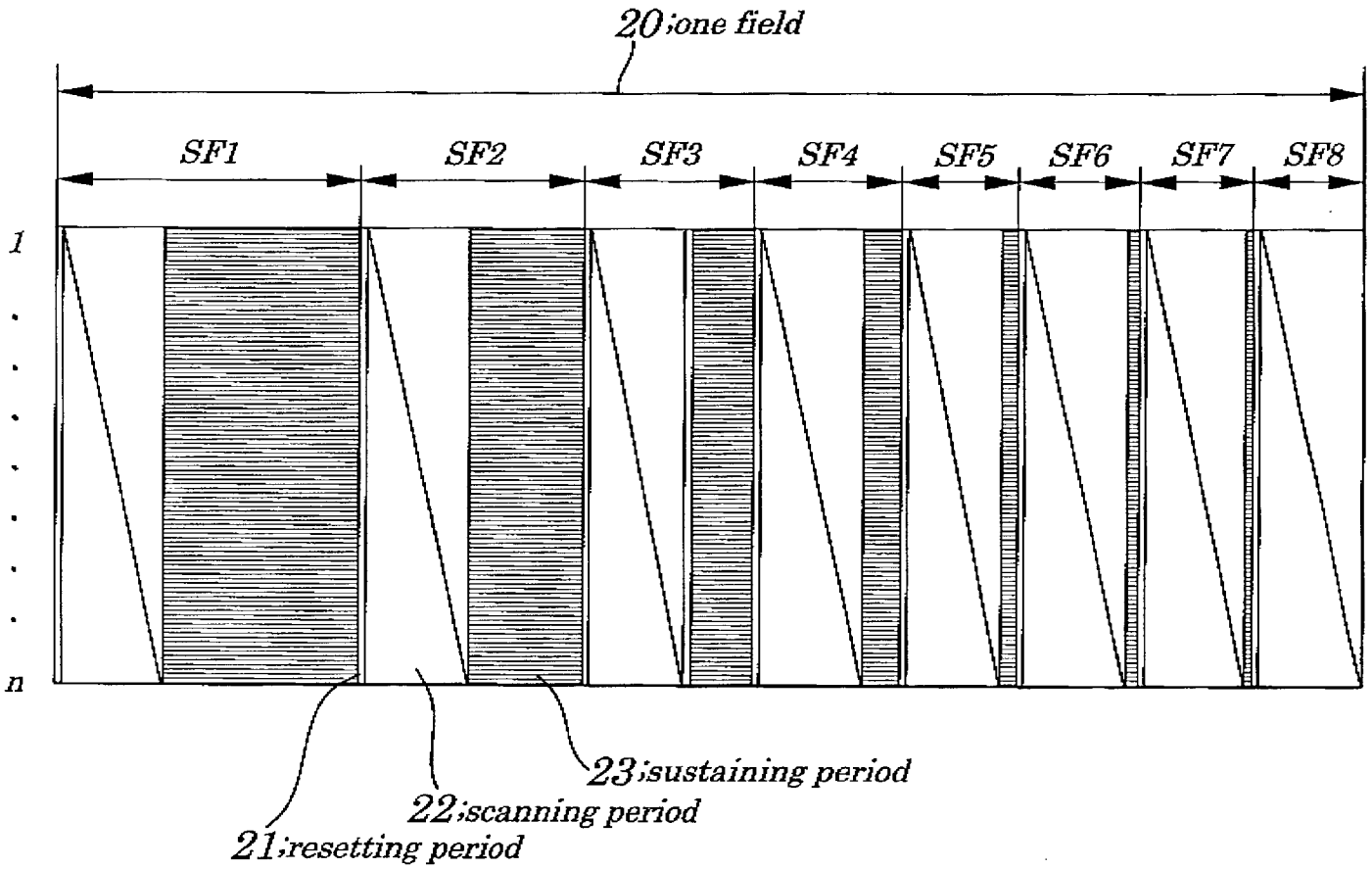
FIG.8 (PRIOR ART)
FIG. 8 is a timing chart showing periods contained in one field in a method of driving the conventional PDP.
Figure 9:
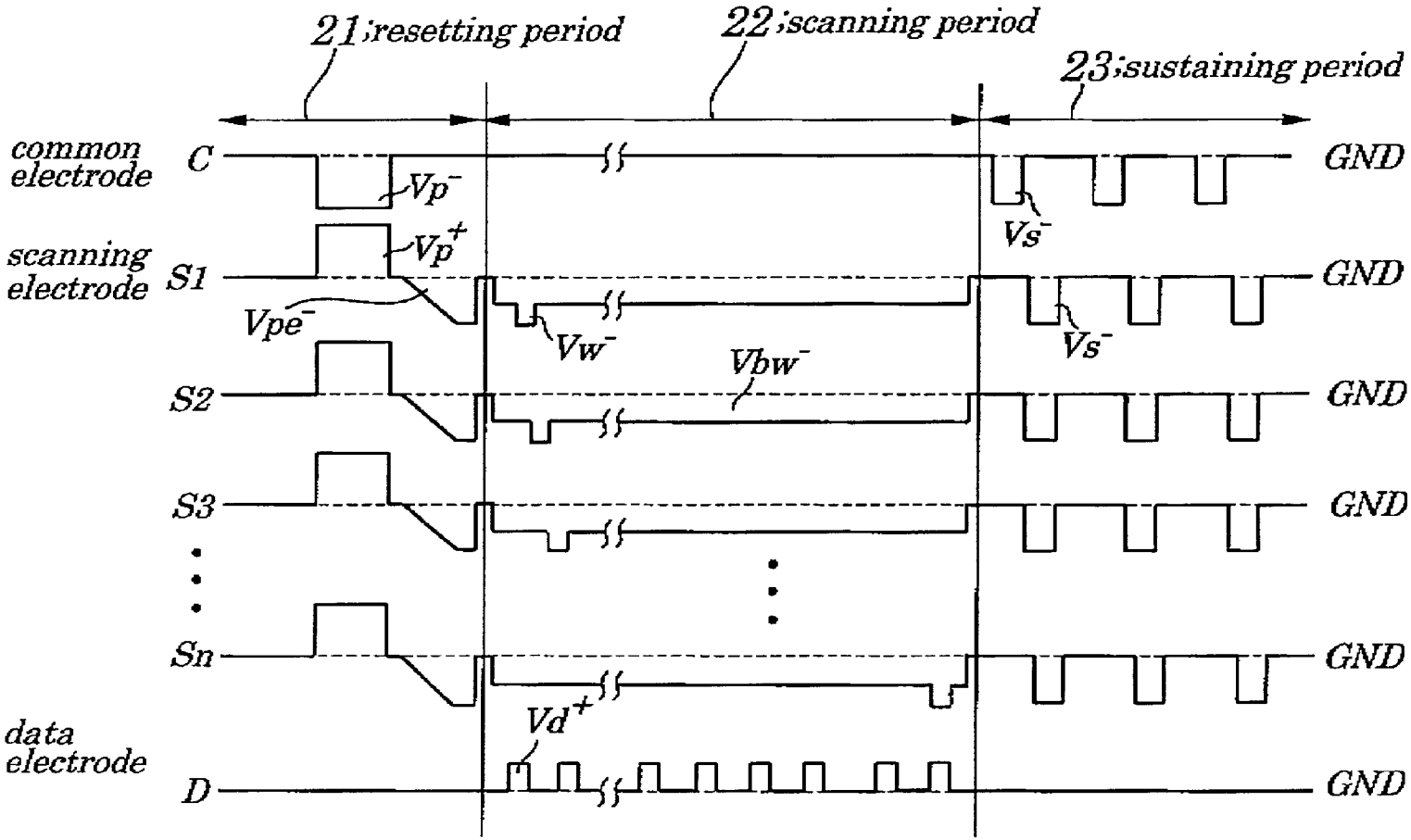
FIG.9 (PRIOR ART)
FIG. 9 is a diagram showing waveforms of pulses used in the method of driving the PDP for each of conventional sub-fields.
Figure 10A:
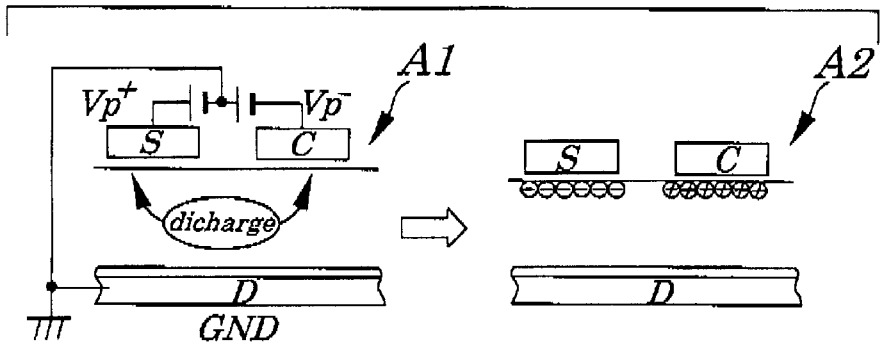
FIG. 10A (PRIOR ART)
FIGS. 10A to 10C are diagrams schematically illustrating arrangements of wall charges formed in each of the display cells when the driving method shown in FIG. 9 is executed.
Figure 10B:
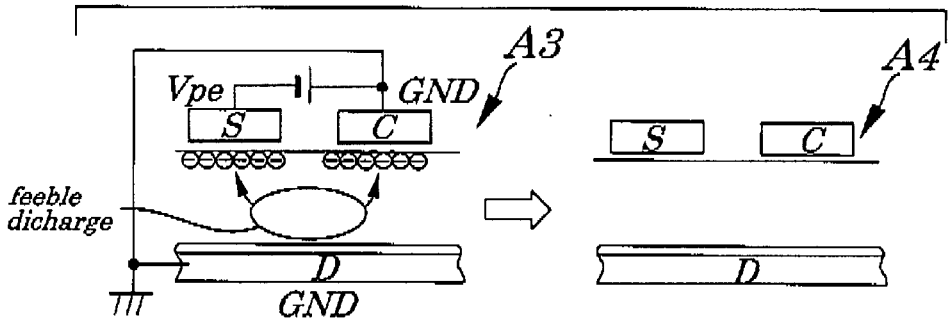
FIG. 10B (PRIOR ART)
Figure 10C:
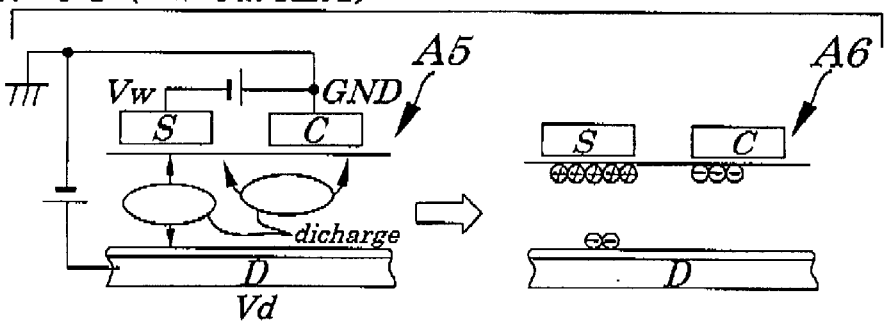
FIG. 10C (PRIOR ART)
Figure 11A:
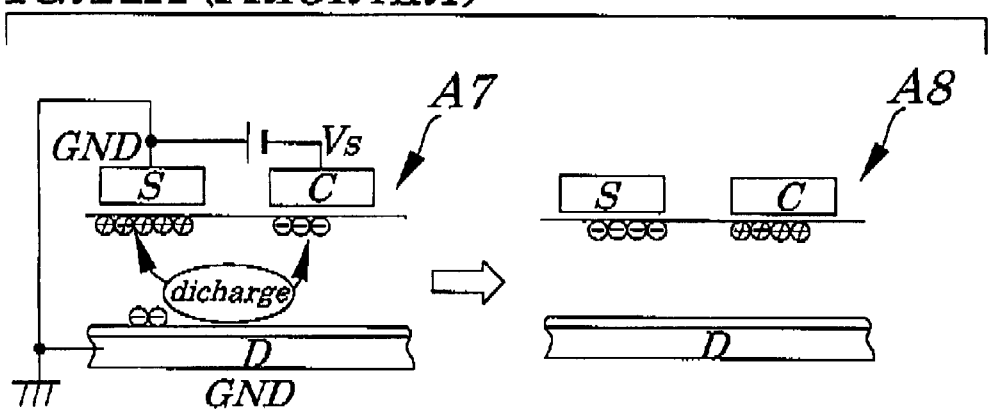
FIG. 11A (PRIOR ART)
FIGS. 11A and 11B are diagrams schematically illustrating arrangements of wall charges formed in each of the display cells when the driving method shown in FIG. 9 is executed and formed during a sustaining period in particular.
Figure 11B:
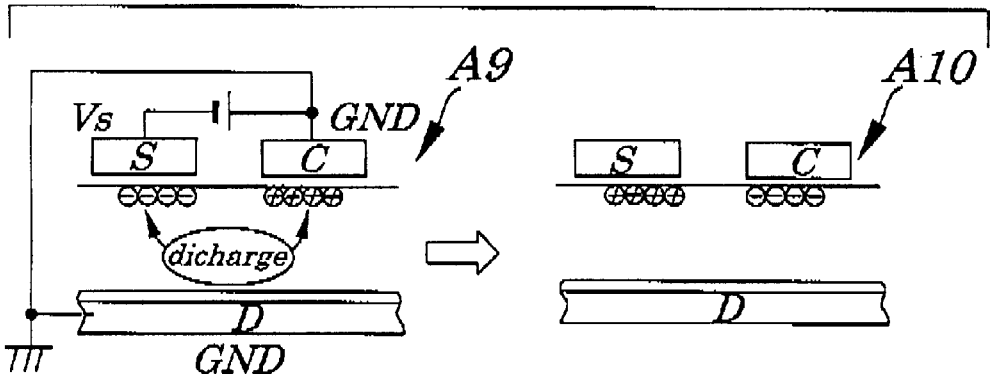
FIG. 11B (PRIOR ART)
Figure 12:
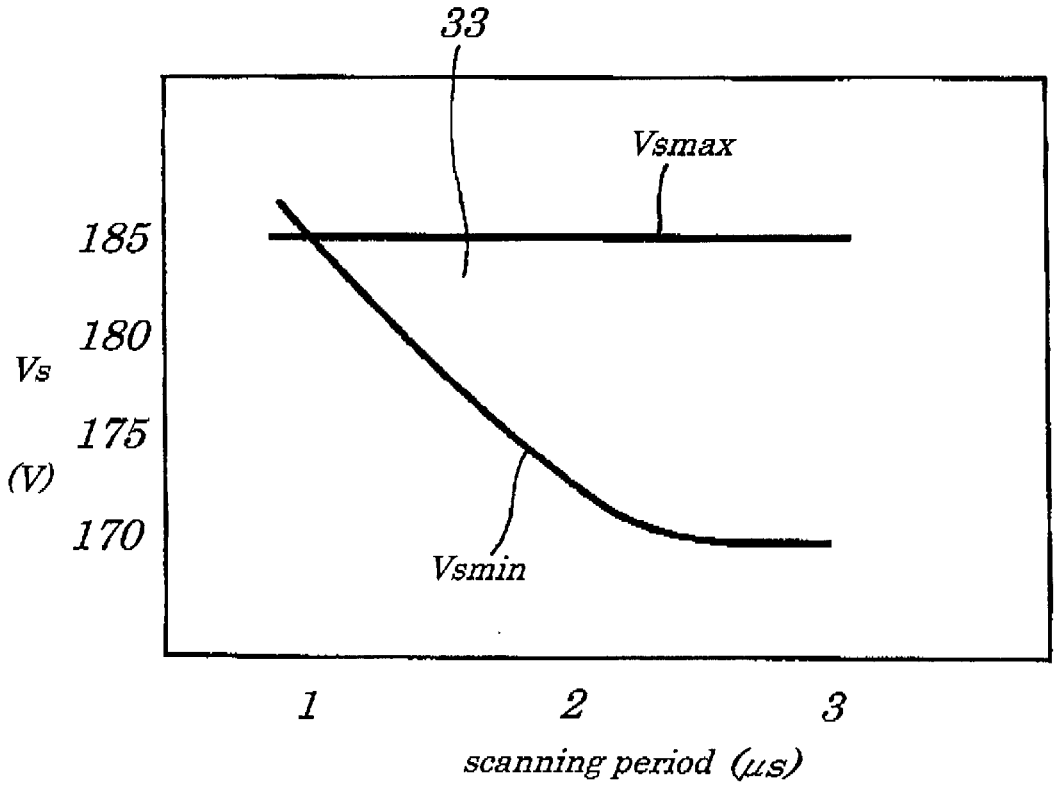
FIG. 12 (PRIOR ART)
FIG. 12 is a graph showing, by plotting a scanning period, that is, scanning time per one line as the abscissa and a sustaining voltage as the ordinate, dependence of a minimum sustaining voltage (Vsmin) required for having sustaining discharge occur in a stable manner and a maximum sustaining voltage (Vsmax) needed to prevent a non-selected display cell from emitting light erroneously on a scanning period.

Configurations of a PDP to be driven in a first embodiment of the present invention are same as those of the conventional PDP shown in FIG. 6. FIG. 1 is a diagram showing waveforms in one sub-field for driving the PDP employed in the first embodiment of the present invention. FIG. 2 is a schematic diagram illustrating an arrangement of wall charges formed in each of display cells (picture cells) during a wall charge forming period by the method for driving the PDP shown in FIG. 1. Moreover, in FIG. 2, a positive wall charge is expressed by a symbol obtained by enclosing "+" with a circle and a negative wall charge is expressed by a symbol obtained by enclosing "−" with a circle. Same ways are employed in FIGS. 4A and 4B.

As shown in FIG. 1, the method for driving the PDP of the first embodiment is an AC-operated driving method in which a scanning period 22 for selecting a display cell and a sustaining period 23 for actually displaying images are provided. Immediately after the scanning period 22, a wall charge forming period 24 is incorporated. In a sub-field, a resetting period 21, the scanning period 22, the wall charge forming period 24, and a sustaining period 23 are provided sequentially in this order.

In the first embodiment of the present invention, the method for driving the PDP during the resetting period 21 and scanning period 22 is same as that employed in the conventional technologies shown in FIG. 9, FIGS. 10A to 10C, and FIG. 11A to FIG. 11B. That is, during the resetting period 21, by applying a priming pulse Vp+ of a positive polarity to each of the scanning electrodes S and a priming pulse Vp− of a negative polarity to each of the common electrodes C, priming discharge (preliminary discharge) is made to occur between the surface over the scanning electrode S (see FIG. 6) and the surface over the common electrode C. This causes negative wall charges to be formed on each of the scanning electrodes S and positive wall charges to be formed on each of the common electrodes C. Next, first, each of the common electrodes C is made to be at a GND potential and a priming erasing pulse Vpe of a negative polarity having a saw-tooth shaped waveform whose potential lowers from the GND potential in a consecutive manner is applied to each of the scanning electrodes S. This causes feeble discharge (priming erasing discharge) to occur between the surface over the scanning electrode S and the surface over the common electrodes C, and the resulting priming discharge serves to erase the formed wall charges. As a result, states of the wall charges in each of the display cells 15 are reset.

Next, during the scanning period 22, a scanning pulse Vw of a negative polarity is sequentially applied to each of scanning electrodes S1 to Sn and a data pulse Vd of a positive polarity is applied, based on display data, in synchronization with the scanning pulse Vw selectively to each of data electrodes D. This causes writing discharge to occur in the display cells 15 selected based on the display data. At this point, a scanning period, that is, a time interval during which the scanning pulse Vw is applied to each of the scanning electrodes S is set to be shorter compared with the conventional case. Because of this, ions and electrons are produced in each of the display cells 15 where the writing discharge has occurred, however, the produced ions and electrons are not sufficiently attracted on each of the scanning electrodes S, the common electrodes C, and the data electrodes D. Therefore, sufficient wall charges are not formed in each of the display cells 15.

Next, during the wall charge forming period 24, while each of the common electrodes C and the data electrodes D is kept at a GND potential, a wall charge forming pulse Vwm having a same potential as that of the scanning pulse Vw is applied to all the scanning electrodes S. A time interval between the wall charge forming pulses Vwm is set to be, for example, 3 μsec to 50 μsec. This causes an electric field having almost a same direction as that of the electric field produced in the display cells 15 to which the data pulse Vd has been applied during the scanning period 22 to occur in each of the display cells 15. At this point, no discharge occurs in both the selected and non-selected display cells. However, since, as a result of the application of the electric field, large amounts of ions and electrons are left in the display cells 15 where the writing discharge occurred during the scanning period 22, above all in the display cells 15 existing in a vicinity of a final line to be scanned, as illustrated as a state "A11" in FIG. 2, ions having positive electric charges are attracted over the specified scanning electrodes S, whereas electrons having negative electric charges are attracted over the specified common electrodes C, and over the specified data electrodes D. As a result, as illustrated as a state "A12" in FIG. 2, negative wall charges are formed on each of the scanning electrodes S and positive wall charges are formed on each of the common electrodes C, and the data electrodes D. That is, the wall charge forming pulse Vwm serves to attract space charges on a surface of a dielectric layer 12 of each of the scanning electrodes S, the common electrodes C, and the data electrodes D. This enables a scanning period to be shortened and even if the formation of wall charges during the scanning period 22 is insufficient, the formation of wall charges can be enhanced during the wall charge forming period 24.

Next, operations during the sustaining period 23 are explained. A driving method during the sustaining period 23 of the embodiment is same as that employed in the conventional technology shown in FIG. 9. That is, first, each of the scanning electrodes S is made at a GND potential and a sustaining pulse Vs of a negative polarity is applied to each of the common electrodes C. As a result, in the display cells 15 where writing discharge has occurred during the scanning period 22, a sustaining pulse Vs is superimposed on a wall voltage produced by wall charges, which causes a first-time sustaining discharge to occur between the surface the scanning electrode S and the surface over the common electrodes C. In the display cells 15 where no writing discharge has occurred, no sustaining discharge occurs. Next, by applying the sustaining pulse Vs of a negative polarity to each of the scanning electrodes S and by making each of the common electrodes C be at a GND potential, in the display cells where first-time sustaining discharge has occurred, a second-time sustaining discharge occurs. Thus, by applying the sustaining pulse Vs repeatedly, light is emitted only in the display cells 15 selected during the scanning period 22. By selecting the sub-field during which light is emitted and combining the selected sub-field in each of the display cells 15, desired display is achieved.

Thus, in the first embodiment, by providing the wall charge forming period 24 between the scanning period 22 and the sustaining period 23 and by applying the wall charge forming pulse Vwm to each of the scanning electrodes S during the wall charge forming period 24, an electric field having almost a same direction as an electric field applied by the scanning pulse Vw and the data pulse Vd can be fed immediately after the scanning period 22. This enables electrons and ions produced in each of the display cells 15 induced by writing discharge to be attracted on each of the scanning electrodes S, the common electrodes C, and the data electrodes D and an amount of wall charges produced to be increased.

As a result, even if the scanning time is shortened, sufficient wall charges are formed and it is therefore to secure a wide range within which a voltage to induce sustaining discharge can be set. As a result, the sustaining discharge occurs in a stable manner in selected display cells and no erroneous discharge occurs in non-selected display cells, thus enabling excellent display of images being free from flicker. Moreover, since no light is emitted in the non-selected display cells 15 in the scanning period 22, the wall charge forming period 24, and the sustaining period 23, black luminance can be lowered. Also, by shortening the scanning time, a sufficient sustaining period can be secured and luminance on a screen can be enhanced. Furthermore, high definition of images and display of multi-gray shades in the PDP can be achieved with luminance on a screen being kept at a constant level.

In the above embodiment, the wall charge forming pulse Vwm is applied to each of the scanning electrodes S, however, so long as a direction of an electric field being produced is same as the electric field produced when the writing discharge occurred, the wall charge forming pulse Vwm may be applied to each of the common electrodes C. Moreover, the higher a voltage of the wall charge forming pulse Vwm is, the greater wall charge forming effect can be obtained, however, any voltage can be used as the voltage for the wall charge forming pulse Vwm so long as the maximum sustaining voltage (Vsmax) is not lowered excessively due to erroneous discharge. For example, the scanning base pulse Vbw of a negative polarity, which is applied after the application of the scanning pulse Vw to a final line of the scanning electrodes S, whose application time is lengthened, may be used as the wall charge forming pulse Vwm.

Furthermore, if a time interval between the wall charge forming pulses Vwm exceeds 3 μsec, minimum sustaining voltage Vsmin becomes lower than the maximum sustaining voltage Vsmax, which makes easier a stable driving of the PDP. On the other hand, even if the time interval between the wall charge forming pulses Vwm is made not less than 50 μsec, no further effects cannot be obtained. Dependence of the sustaining voltage on the time interval between the wall charge forming pulse Vwm on the time interval varies depending on a structure of the display cells, a type of discharging gas, a pressure to be used, or a like, however, from a viewpoint of a relation to driving time, the time interval between the wall charge forming pulses Vwm is preferably 3 μsec to 50 μsec.

Second Embodiment

Figure 3:
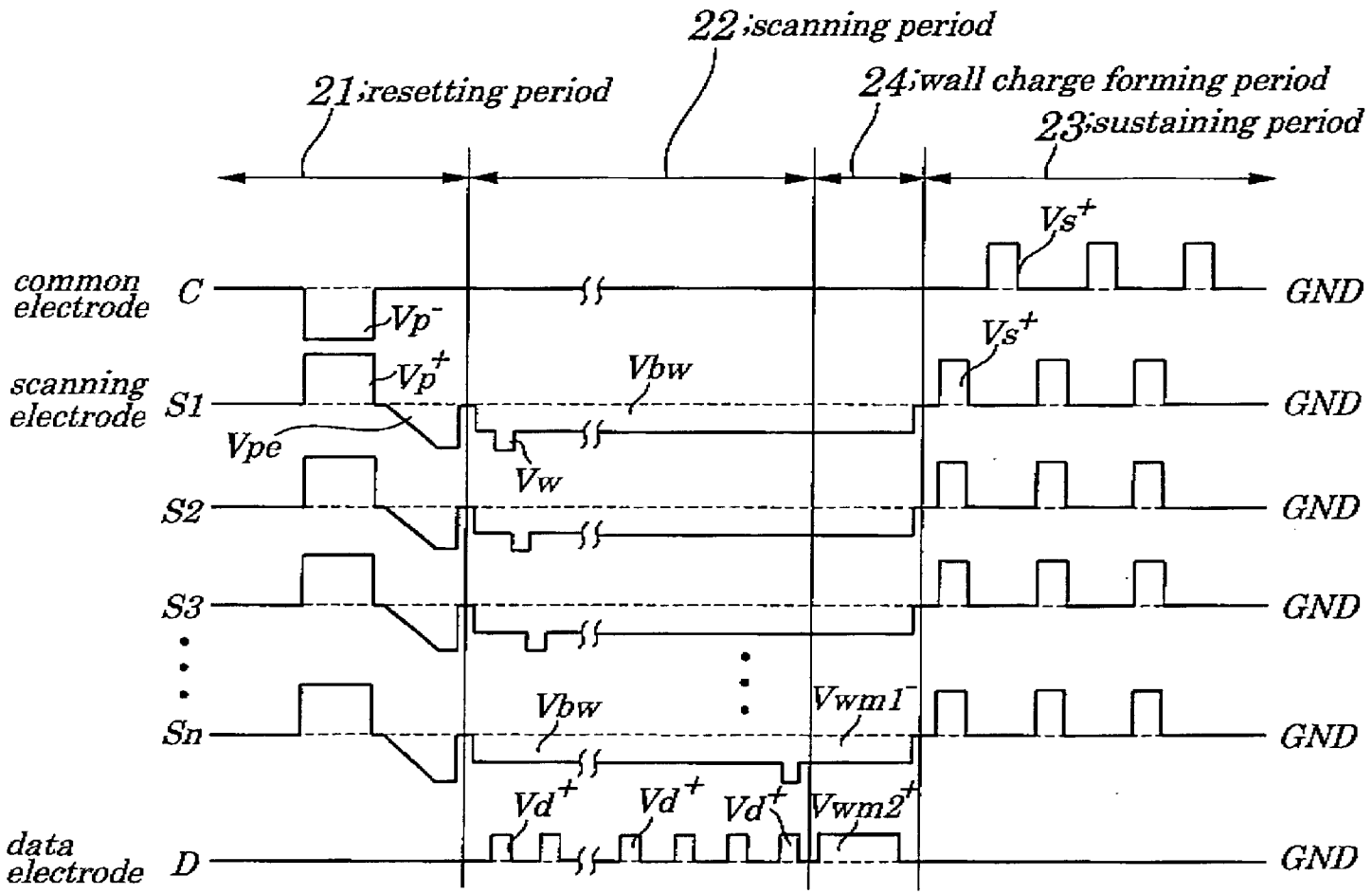
FIG. 3 is a diagram showing waveforms for a method of driving a PDP according to a second embodiment of the present invention.
Figure 4A:
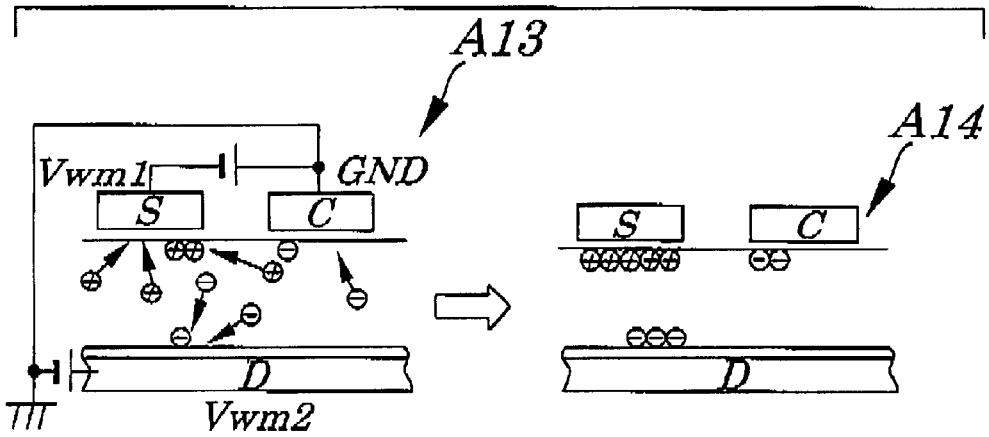
FIGS. 4A and 4B are diagrams schematically illustrating arrangements of wall charges formed in each of the display cells when the driving method shown in FIG. 3 is executed and, FIG. 4A is a diagram illustrating arrangements of wall charges formed during a wall charge forming period
Figure 4B:
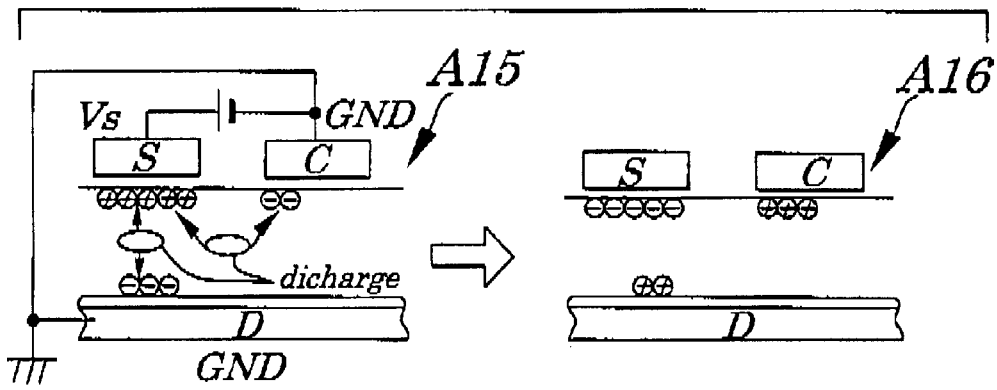

FIG. 3 is a diagram showing waveforms for a method of driving a PDP according to a second embodiment of the present invention. FIGS. 4A and 4B are diagrams schematically illustrating arrangements of wall charges formed in each of display cells when the driving method shown in FIG. 3 is executed and, FIG. 4A is a diagram illustrating arrangements of wall charges formed during a wall charge forming period and FIG. 4B is a diagram illustrating an arrangement of wall charges formed during a scanning period. In the second embodiment, the same PDP as used in the first embodiment is employed. Moreover, the method for driving the PDP used during a resetting period 21 and a scanning period 22 in the second embodiment is same as that employed during the resetting period 21 and scanning period 22 in the first embodiment.

In the driving method of the second embodiment, as shown in FIG. 3, during a wall charge forming period 24, first, each of common electrodes C is made to be at a GND potential and then a wall charge forming pulse Vwm1 of a negative polarity is applied to each of scanning electrodes S and a wall charge forming pulse Vwm2 of a positive polarity is applied to each of data electrodes D. The wall charge forming pulse Vwm1 to be applied to each of the scanning electrodes S is obtained by extending time for the application of a scanning base pulse Vbw to each of the scanning electrodes S during the scanning period 22 until an end point of the wall charge forming period 24. A potential of the wall charge forming pulse Vwm1 is same as that of the scanning base pulse Vbw and a potential of the wall charge forming pulse Vwm2 is same as that of a data pulse Vd. Therefore, a voltage obtained by superimposing the wall charge forming pulse Vwm1 on the wall charge forming pulse Vwm2 does not reach a opposed-discharge firing voltage. A time interval between the wall charge forming pulses Vwm and between the wall charge forming pulse Vwm2 is, for example, 3 μsec to 50 μsec.

This causes, as illustrated as a state "A13" in FIG. 4A, ions occurred in each of the display cells 15 by occurrence of writing discharge during the scanning period 22 to be attracted to each of the scanning electrodes S by the wall charge forming pulse Vwm1 and electrons occurred in each of the display cells 15 to be attracted to each of the data electrodes D by the wall charge forming pulse Vw2. As a result, as illustrated as a state "A14" in FIG. 4A, positive wall charges are formed on each of the scanning electrodes S and negative wall charges are formed on each of the data electrodes D and the common electrodes C. At this point, a larger amount of the negative wall charges is formed on each of the data electrodes D when compared with the amount of the negative wall charges formed on each of the data electrodes D at a point (see the state "A12" in FIG. 2) of an end of the wall charge forming period in the first embodiment.

Next, during the sustaining period 23, first, each of the data electrodes D and the common electrodes C is made to be at a GND and then a sustaining pulse Vs of a positive polarity is applied to each of the scanning electrodes S. Thus, in the second embodiment, the sustaining pulse Vs has a polarity being reverse to that of the scanning pulse Vw. In the display cells 15 where the writing discharge has occurred during the scanning period 22, as illustrated as a state "A15" in FIG. 4, the wall voltage induced by the positive wall charge formed on each of the scanning electrodes S and by the negative wall charge formed on each of the common electrodes C is superimposed on the voltage of the sustaining pulse Vs of a positive polarity applied to each of the scanning electrodes S, thus causing surface-discharge to occur. At this point, since a large amount of wall charges is formed on each of the data electrodes D, the wall voltage induced by the positive wall charge formed on each of the scanning electrodes S and by the negative wall charge formed on each of the data electrodes D is superimposed on the voltage of the sustaining pulse Vs of a positive polarity applied to each of the scanning electrodes S, thus causing opposed-discharge also to occur. The surface-discharge and opposed-discharge act as a first-time sustaining discharge. As a result, as illustrated as a state "A16" in FIG. 4, negative wall charges are formed on each of the scanning electrodes S and positive wall charges are formed on each of the common electrodes C and each of the data electrodes D.

Next, each of the scanning electrodes S is made to be at a GND potential and then a positive sustaining pulse Vs is applied to each of the common electrodes C. As a result, in each of the display cells 15 where the first-time sustaining discharge has occurred, the wall charges illustrated as the state "A16" are superimposed on a voltage of the sustaining pulse Vs, thus causing a second-time sustaining discharge to occur. Similarly thereafter, by alternately applying a positive sustaining pulse Vs to each of the scanning electrodes S and each of the common electrodes C, the sustaining discharge continues in each of the display cells 15 where writing discharge has occurred in the scanning period 22.

In the second embodiment, when the wall charge forming pulse Vwm2 of a positive polarity is applied during the wall charge forming period 24 and the sustaining pulse Vs of a positive polarity is applied to each of the scanning electrodes S for the sustaining discharge during a sustaining period 23, the opposed-discharge, besides the surface discharging, tends to occur readily and a rate of probability of the occurrence of sustaining discharge rises. As a result, excellent display of images with less flicker can be achieved.

In the above first and second embodiments, the waveform of the pulses for driving the PDP is configured by combining pulses of a positive polarity and of a negative polarity, however, the waveform of the pulses for driving the PDP may be configured by using pulses of a positive polarity only or of a negative polarity only. Moreover, the polarity of the wall charge forming pulse Vwm relative to the GND is changed at a same time.

Figure 5:
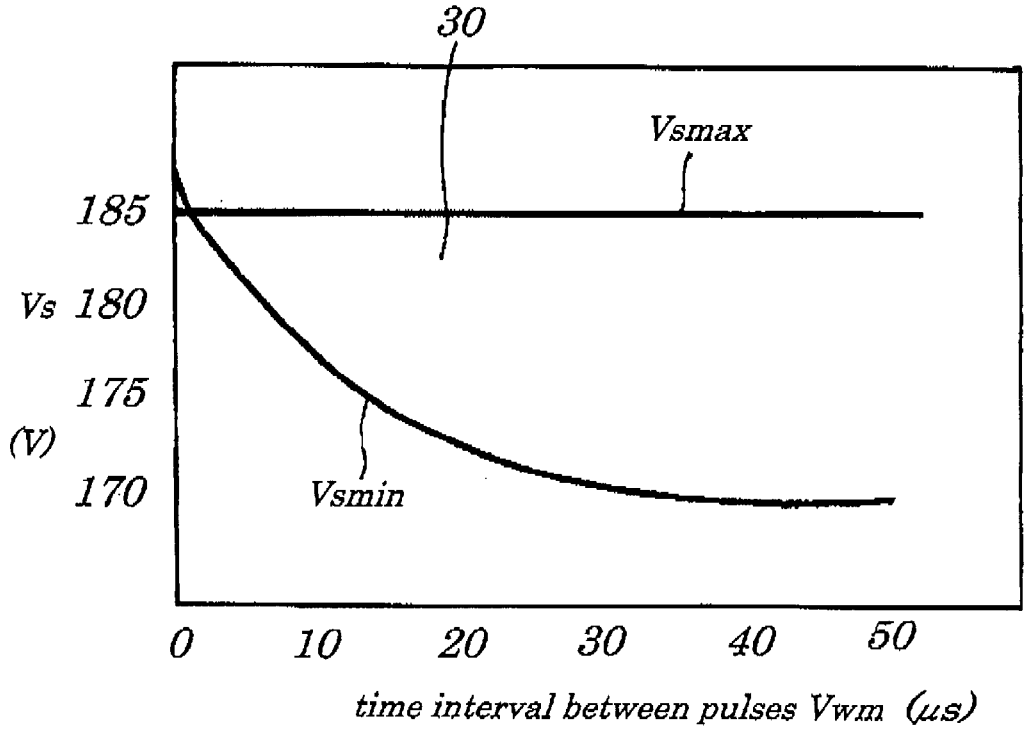
FIG. 5 is a graph showing an influence of a time interval between wall charge forming pulses on a voltage setting range of a sustaining pulse by plotting the time interval between the wall charge forming pulses as the abscissa and by plotting a voltage of sustaining pulse Vs as the ordinate employed in an example to describe effects to be obtained by the present invention.

Hereafter, effects that can be obtained by the above embodiments of the present invention are explained by comparing an example with that departing from a scope of claims of the present invention. In this example, a PDP being 50 inches in size is used and this PDP is driven by the waveforms of pulses shown in FIG. 1. At this point, with the scanning period being set to be 1 μsec and with the time interval between the wall charge forming pulses Vwm being changed, a minimum sustaining voltage (Vsmin) required for having sustaining discharge occur in selected display cells in a stable manner and a maximum sustaining voltage (Vsmax) that can prevent non-selected display cells from erroneous light emitting are measured. FIG. 5 is a graph showing an influence of a time interval between wall charge forming pulses on a voltage setting range of a sustaining pulse by plotting the time interval between the wall charge forming pulses as abscissa and by plotting a voltage of sustaining pulse Vs as ordinate employed in the example used to describe effects to be obtained by the present invention.

Figure 13A:
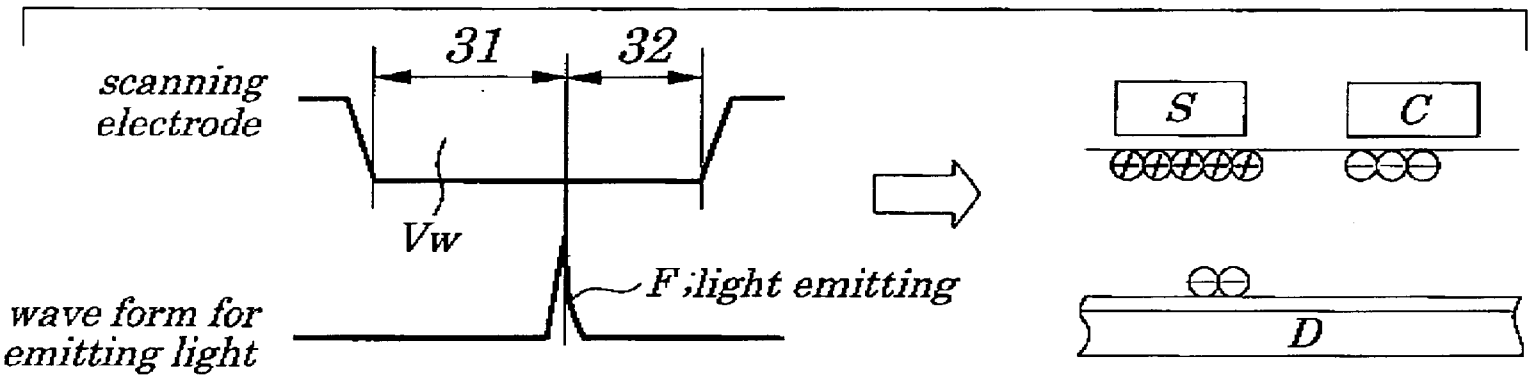
FIG. 13A (PRIOR ART)
FIGS. 13A and 13B are diagrams schematically illustrating behavoir in which wall charges are formed after application of a scanning pulse and FIG. 13A shows a case where a scanning period is sufficiently long and FIG. 13B shows a case where the scanning period is short.
Figure 13B:
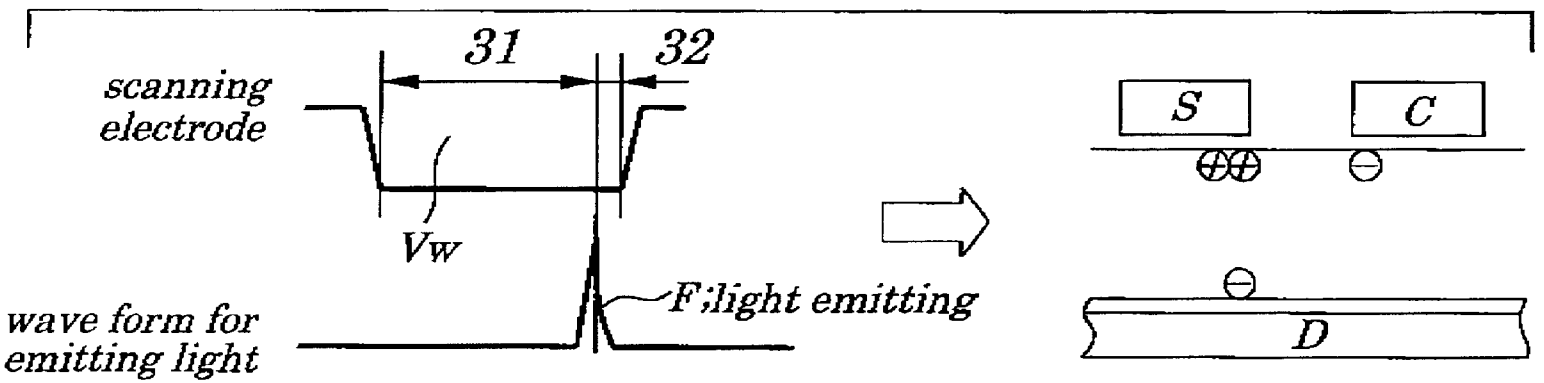
FIG. 13B (PRIOR ART)

As shown in FIG. 5, if the time interval between the wall charge forming pulses Vwm is 0, that is, if no wall charge forming pulse Vwm is applied to each of the scanning electrodes S as in the case of the conventional method, the minimum sustaining voltage Vsmin rises remarkably and becomes higher than the maximum sustaining voltage Vsmax. This is because the scanning period was 1 μsec and, as shown in FIG. 13B, writing discharge (light emitting F) occurred immediately before an end of the scanning pulse Vw, which interfered with sufficient formation of wall charges.

In contrast to the above case, if the time interval between the wall charge forming pulses Vwm is made longer, the minimum sustaining voltage Vsmin is lowered and a normal operating range 30 is made wider. This is a result of inhibiting occurrence of flickers in the display cells existing in a vicinity of a final line to be scanned by the wall charge forming pulse Vwm. In particular, by setting the time interval of the wall charge forming pulse Vwm to exceed 3 μsec, the minimum sustaining voltage Vsmin surely becomes lower than the maximum sustaining voltage Vsmax, which enabled the PDP to be easily driven in a stable manner. On the other hand, as the time interval between the wall charge forming pulses is made longer, the minimum sustaining voltage Vsmin is lowered more, however, when the time interval between the wall charge forming pulses reaches about 50 μsec, no further effects cannot be obtained. It is thought that this is because, when the time interval between the wall charge forming pulses has reached 50 μsec, most of the charges within discharging space is attracted on each of the electrodes S, the common electrodes C, and the data electrodes D, which reduces the charges within the discharging space. Dependency of the sustaining voltage on the time interval between the wall charge forming pulses varies depending on structures of the display cells 15, kinds of discharging gas, or a like, however, from a viewpoint of a relation to driving time, it is preferable that the time interval between the wall charge forming pulses is set to be within a range of 3 μsec to 50 μsec.

It is apparent that the present invention is not limited to the above embodiments but may be changed and modified without departing from the scope and spirit of the invention.

What is claimed is:

1. A method of driving an AC surface-discharge type plasma display panel having first and second insulating substrates placed so as to face each other, a plurality of scanning electrodes and a plurality of common electrodes being placed on a side of a face of said first insulating substrate facing said second insulating substrate and being extended in a first direction and being alternately arranged, a first dielectric layer to cover said plurality of said scanning electrodes and said plurality of said common electrodes, a plurality of data electrodes being placed on a side of a surface of said second insulating substrate facing said first insulating substrate and being extended in a second direction orthogonal to said first direction, and a second dielectric layer to cover said plurality of said data electrodes, for having a surface-discharge alternating-current-type plasma display panel, in which picture cells are formed in a matrix form in a manner that each of said picture cells contains one nearest contact point of each of said plurality of said data electrodes to each of said plurality of said scanning electrodes and one nearest contact point of each of said plurality of said data electrodes to each of said plurality of said common electrodes and that a discharge gap is formed between each of said plurality of said scanning electrodes and each of said plurality of said common electrodes in each of said picture cells, display images based on display data, said method comprising:

a step of constructing one field to display one image of one sub-field or a plurality of sub-fields and;

wherein said sub-field is made up of a resetting period during which a state of an electric charge in each of said picture cells is initialized, a scanning period during which a scanning pulse is sequentially applied to each of said scanning electrodes and, at a same time, a data pulse is selectively applied, based on said display data, to said data electrodes with same timing as for said scanning pulse to cause writing discharge to selectively occur in each of picture cells, a wall charge forming period during which wall charges are formed in said picture cells where said writing discharge has occurred by application of a wall charge forming pulse having an orientation of an electric field determined by a relative relation of potentials among three types of electrodes one being said scanning electrodes, another being common electrodes, and an other being data electrodes being same as an orientation of an electric field produced at a time of said writing discharge during said scanning period, to one electrode or two or more electrodes selected from a group consisting of said scanning electrodes, said common electrodes, and said data electrodes, and a sustaining period during which sustaining discharge is made to occur between a scanning electrode region over said scanning electrode in a surface of said first dielectric layer and a common electrode region over said common electrode in said surface of said first dielectric layer in said picture cell where wall charges have been formed by applying a sustaining pulse alternately to said scanning electrode and said common electrode.

2. The method of driving the AC surface-discharge type plasma display panel according to claim 1, wherein a time interval between said wall charge forming pulses is 3 μsec to 50 μsec.

3. The method of driving the AC surface-discharge type plasma display panel according to claim 1, wherein, during said scanning period, a scanning pulse of a negative polarity is applied to each of said scanning electrodes and, at a same time, a data pulse of a positive polarity is applied selectively to desired said data electrodes and wherein, during said wall charge forming period, a wall charge forming pulse of a negative polarity is applied to each of said scanning electrodes.

4. The method of driving the AC surface-discharge type plasma display panel according to claim 1, wherein, during said scanning period, a scanning pulse of a negative polarity is applied to each of said scanning electrodes and, at a same time, a data pulse of a positive polarity is selectively applied to desired said data electrodes and wherein, during said wall charge forming period, a wall charge forming pulse of a negative polarity is applied to each of said scanning electrodes and, at a same time, a wall charge forming pulse of a positive polarity is applied to desired said data electrodes.

5. The method of driving the AC surface-discharge type plasma display panel according to claim 1, wherein, during said scanning period, a scanning pulse of a negative polarity is applied to each of said scanning electrodes and, at a same time, a data pulse of a positive polarity is selectively applied to desired said data electrodes and wherein, during said wall charge forming period, a wall charge forming pulse of a positive polarity is applied to said common electrodes.

6. The method of driving the AC surface-discharge type plasma display panel according to claim 5, wherein said wall charge forming pulse of a positive polarity to be applied to desired said data electrodes is obtained by extending time for application of a final data pulse during said scanning period.

7. The method of driving the AC surface-discharge type plasma display panel according to claim 1, wherein, during a period of time within said scanning period in which said scanning pulse is not applied to each of said scanning electrodes, a scanning base pulse of a negative polarity whose voltage is less than a voltage obtained by subtracting a voltage of said data pulse from a opposed-discharge firing voltage is applied to each of said scanning electrodes.

8. The method of driving the AC surface-discharge type plasma display panel according to claim 7, wherein said wall charge forming pulse is obtained by extending time for application of said scanning base pulse.

9. A method of driving an AC surface-discharge type plasma display panel having: a first insulating substrate and a second insulating substrate arranged opposite each other, a plurality of scanning electrodes and a plurality of common electrodes alternatively arranged on an opposition surface of said first insulating substrate to said second insulating substrate in a first direction, a plurality of data electrodes arranged on an opposition side of said second insulating substrate to said first insulating substrate in a second direction perpendicular to said first direction, a first dielectric layer formed to cover said plurality of scanning electrodes and said plurality of common electrodes, a second dielectric layer formed to cover said plurality of data electrodes, a plurality of discharge gaps arranged between said scanning electrodes and said common electrodes, and a plurality of picture cells each of which includes one of cross points of said discharge gaps and data electrodes;

a step of constructing one field to display one image of one sub-field or a plurality of sub-fields and;

wherein said sub-field is made up of a resetting period during which a state of an electric charge in each of said picture cells is initialized, a scanning period during which a scanning pulse is sequentially applied to each of said scanning electrodes and, at a same time, a data pulse is selectively applied, based on said display data, to said data electrodes with same timing as for said scanning pulse to cause writing discharge to selectively occur in each of picture cells, a wall charge forming period during which wall charges are formed in said picture cells where said writing discharge has occurred by application of a wall charge forming pulse having an orientation of an electric field determined by a relative relation of potentials among three types of electrodes one being said scanning electrodes, another being common electrodes, and an other being data electrodes being same as an orientation of an electric field produced at a time of said writing discharge during said scanning period, to one electrode or two or more electrodes selected from a group consisting of said scanning electrodes, said common electrodes, and said data electrodes, and a sustaining period during which sustaining discharge is made to occur between a scanning electrode region over said scanning electrode in a surface of said first dielectric layer and a common electrode region over said common electrode in said surface of said first dielectric layer in said picture cell where wall charges have been formed by applying a sustaining pulse alternately to said scanning electrode and said common electrode.

10. The method of driving the AC surface-discharge type plasma display panel according to claim 9, wherein a time interval between said wall charge forming pulses is 3 μsec to 50 μsec.

11. The method of driving the AC surface-discharge type plasma display panel according to claim 9, wherein, during said scanning period, a scanning pulse of a negative polarity is applied to each of said scanning electrodes and, at a same time, a data pulse of a positive polarity is applied selectively to desired said data electrodes and wherein, during said wall charge forming period, a wall charge forming pulse of a negative polarity is applied to each of said scanning electrodes.

12. The method of driving the AC surface-discharge type plasma display panel according to claim 9, wherein, during said scanning period, a scanning pulse of a negative polarity is applied to each of said scanning electrodes and, at a same time, a data pulse of a positive polarity is selectively applied to desired said data electrodes and wherein, during said wall charge forming period, a wall charge forming pulse of a negative polarity is applied to each of said scanning electrodes and, at a same time, a wall charge forming pulse of a positive polarity is applied to desired said data electrodes.

13. The method of driving the AC surface-discharge type plasma display panel according to claim 9, wherein, during said scanning period, a scanning pulse of a negative polarity is applied to each of said scanning electrodes and, at a same time, a data pulse of a positive polarity is selectively applied to desired said data electrodes and wherein, during said wall charge forming period, a wall charge forming pulse of a positive polarity is applied to said common electrodes.

14. The method of driving the AC surface-discharge type plasma display panel according to claim 13, wherein said wall charge forming pulse of a positive polarity to be applied to desired said data electrodes is obtained by extending time for application of a final data pulse during said scanning period.

15. The method of driving the AC surface-discharge type plasma display panel according to claim 9, wherein, during a period of time within said scanning period in which said scanning pulse is not applied to each of said scanning electrodes, a scanning base pulse of a negative polarity whose voltage is less than a voltage obtained by subtracting a voltage of said data pulse from a opposed-discharge firing voltage is applied to each of said scanning electrodes.

16. The method of driving the AC surface-discharge type plasma display panel according to claim 15, wherein said wall charge forming pulse is obtained by extending time for application of said scanning base pulse.

* * * * *